United States Patent [19]

Lambert

[11] Patent Number: 4,748,604

[45] Date of Patent: May 31, 1988

[54] WATCH CASE FUNCTIONING AS A CLASP, THE CLASP-WATCH CASE, BEING LOCKED BY A PRESS BUTTON

[75] Inventor: Pierre Lambert, Goumois, Switzerland

[73] Assignee: Class S.p.A., Switzerland

[21] Appl. No.: 934,612

[22] PCT Filed: Feb. 27, 1986

[86] PCT No.: PCT/IT86/00017

§ 371 Date: Nov. 19, 1986

§ 102(e) Date: Nov. 19, 1986

[87] PCT Pub. No.: WO86/05077

PCT Pub. Date: Sep. 12, 1986

[30] Foreign Application Priority Data

Mar. 5, 1985 [IT] Italy ..... 47771 A/85

[51] Int. Cl.[4] ..... G04B 37/00; A44C 5/00; A43C 11/00

[52] U.S. Cl. ..... 368/282; 24/71 J; 224/174; 224/176

[58] Field of Search ..... 368/276, 281, 282; 24/68 J, 71 R, 71 J; 224/174–176

[56] References Cited

U.S. PATENT DOCUMENTS

| | | | |
|---|---|---|---|
| 2,169,738 | 8/1939 | Moody | 368/281 |
| 2,429,950 | 10/1947 | Weber | 24/71 J |
| 4,330,905 | 5/1982 | Wolfgang | 24/71 J |

FOREIGN PATENT DOCUMENTS

| | | | |
|---|---|---|---|
| 3435207 | 4/1986 | Fed. Rep. of Germany | 24/71 J |
| 54478 | 5/1950 | France . | |
| 141364 | 10/1930 | Switzerland | 368/281 |
| 162506 | 9/1933 | Switzerland | 24/71 J |

*Primary Examiner*—Vit W. Miska
*Attorney, Agent, or Firm*—Wigman & Cohen

[57] ABSTRACT

An articulated device, consists of three parts (2, 5, 6), for permitting to wear or take off a wrist-watch (1) connected to a strap (7), of a sole length. The first part (2) of this device is so shaped as to receive and partially protect the watch (1). Said part (2) is formed by two parts (3, 4). The part (3) shaped as an annular frame is hinged, at one of its ends, to the intermediate part (5), which at its other end is pivotally connected, to the part (6), so that the parts (5, 6) can rotate in opposite directions to each other. The part (6), at one of its ends is hinged to the end portion (*7b*) of the strap (7), while the other end (*7a*) of this latter is hinged to the opposite end of the part (3). The hinge axes (x—x, y—y, w—w, z—z) of the parts (2, 5, 6) are parallel to each other. The articulated device comprises a spring locking means (15 to 22) including a manually controllable releasing means.

3 Claims, 3 Drawing Sheets

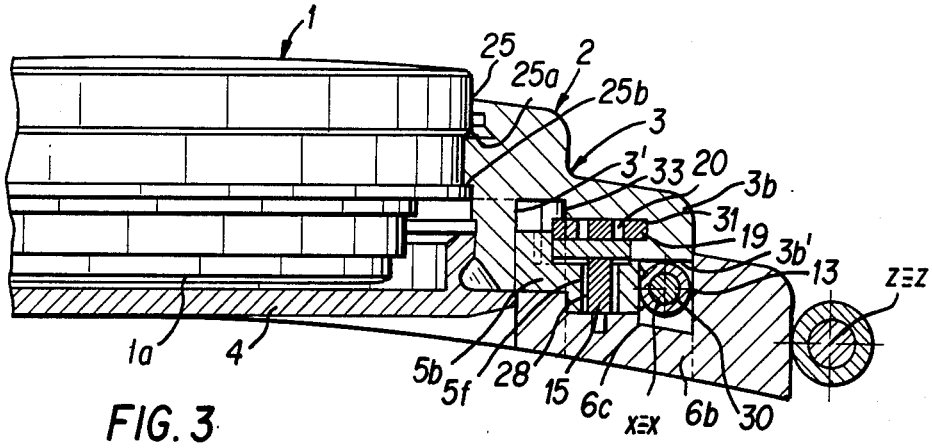
FIG. 3
FIG. 4
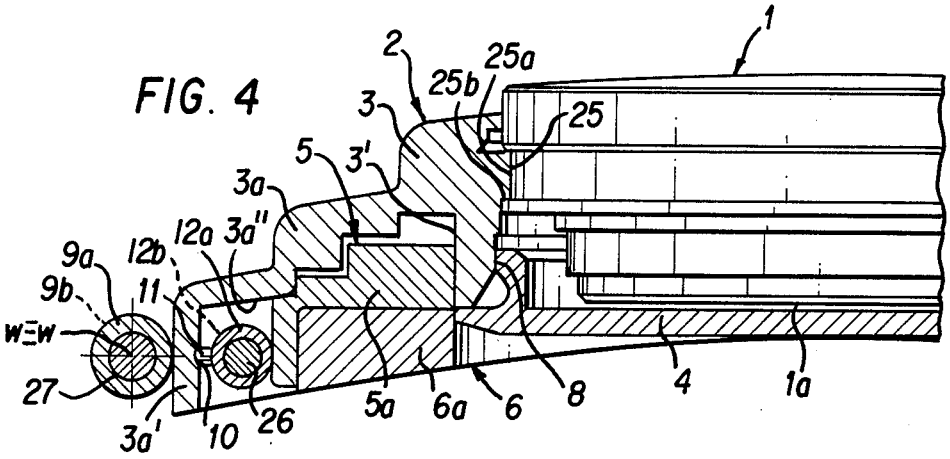
FIG. 5
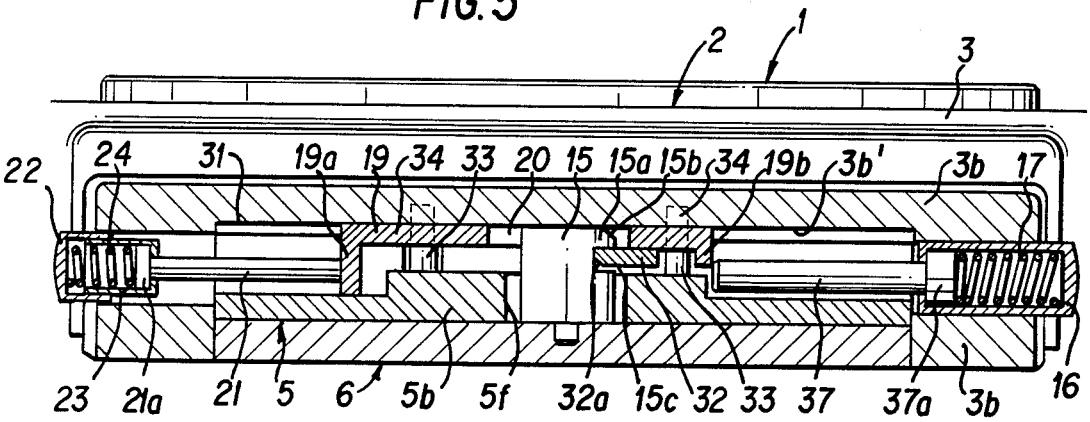

WATCH CASE FUNCTIONING AS A CLASP, THE CLASP-WATCH CASE, BEING LOCKED BY A PRESS BUTTON

This invention relates to an articulated device, designed to be inserted in the strap or bracelet, carrying a wrist watch in order to permit to increase the length of said strap, as the user has to take off the watch so as to allow that the strap together with the watch can be slipped off along the hand, and taken off. Said articulated device is maintained in its closed condition by an automatic locking means provided with a manually controllable realising means.

Devices of this type are already known, applied to metal link strap or bracelets for ladies' or men's wrist-watches, which are formed by links articulated to each other. Said known devices consist of three parts obtained by thin metal sheet, said parts being hinged to each other about parallel axes set at right angles to the strap center plane and which permit, owing to their zig-zag connection, to cause said parts to be superimposed upon each other by means of relative rotary movements in opposite directions, until they attain a use position, in which the parts are in a superimposed or accordion relationship so that the device has a minimum length, to an elongated position of maximum length, when the parts become substantially coplanar.

Said known devices are usually mounted in the central part of a strap or bracelet and therefore this latter must be necessarily cut in two lengths. One of each of said strap lengths is pivotally connected to one of the sides of the body of the watch, and the other to first and to the third element of the articulated device respectively.

The present invention concerns an improved articulated device having substantially an operating structure similar to that of the known devices but which has been modified so as to present the following avantages:

(a) The articulated device, in its operative condition, substantially cannot be seen by any observer, since it is hidden behind the watch body, while the strap or bracelet is formed by a sole continuous band or strip of links.

(b) The first part of the articulated device consists of two elements so shaped and designed as, to form a support and protection means for the watch, since the first element component consists of an annular peripheral frame to receive and to protect laterally the watch body, while the second element protects the bottom wall of the watch-case, where the inner mechanisms of the watch are placed.

(c) The articulated device includes also a safety locking means for said three elements in their closure positions, and which can be released only in the case that the wearer presses an outer control push button.

That prevents the very frequent inconvenience, that, after a sufficiently long time of use, the simple locking elastic hook means which is present in the known types of such devices, becomes inefficient so that the articulated device opens, so that the watch together with the strap can slip off the wearer's hand.

The safety locking means of the invention makes very difficult that the watch can be snatched from the wearer's arm by a thief, since the device of the invention is very strong on account of the aforementioned characteristics and purposes and since the watch together with the strap remains steadily and closely wound around the wearer's wrist.

These and other characteristics and advantages of the present invention will be better understood from the following description of two embodiments of the invention, reference being made to the accompanying drawings, in which.

Figure 1:
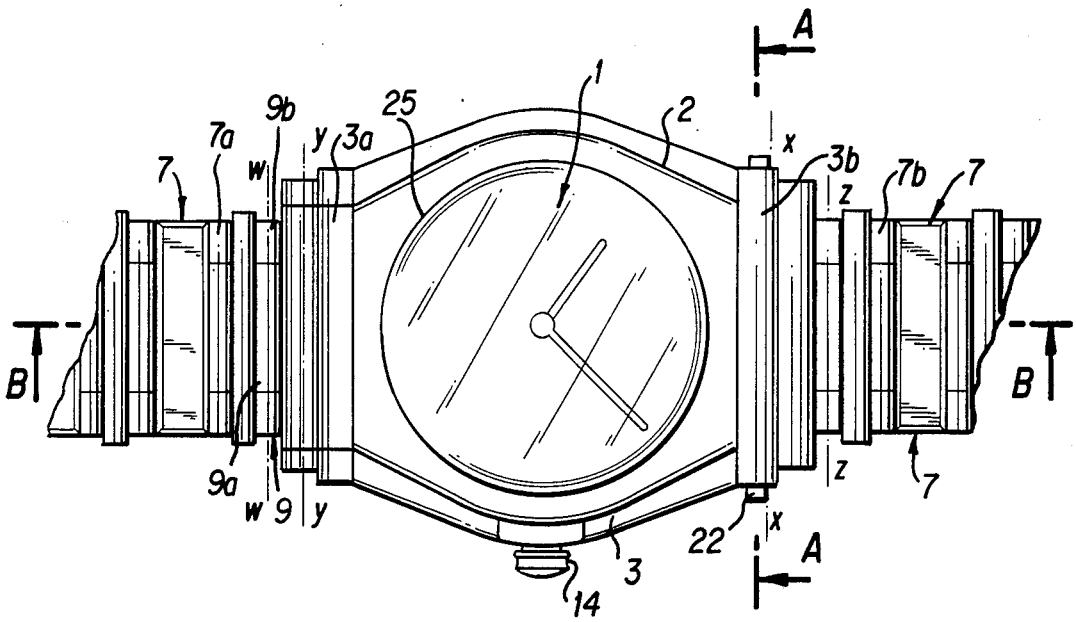
FIG. 1 is a partial front view of a wrist-watch for a man, in the closure condition of the articulated device thereof.
Figure 2:
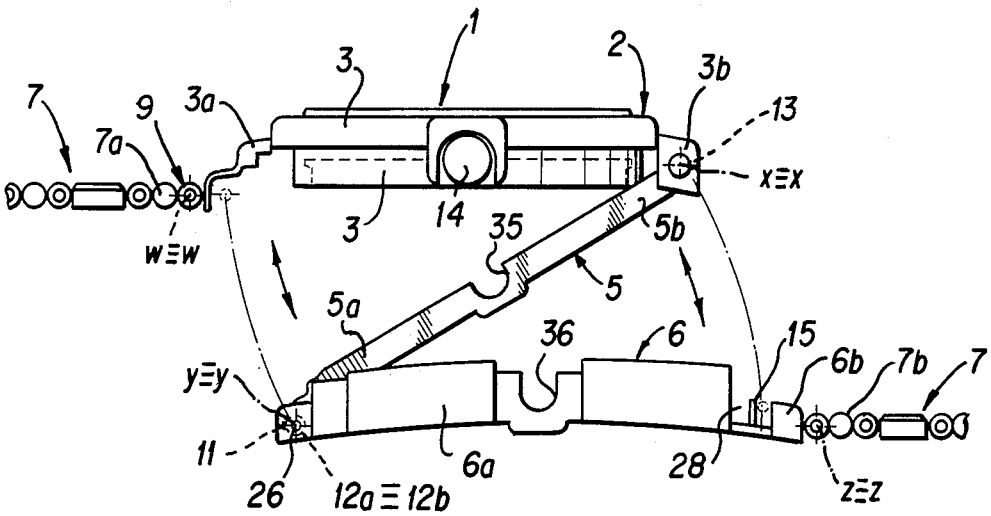
FIG. 2 is a partial longitudinal side view showing the articulated device, of FIG. 1, connected to the watch, when the intermediate and the last elements of the articulated device have reached an intermediate position of the closure or opening cycle of said device.
Figure 6:
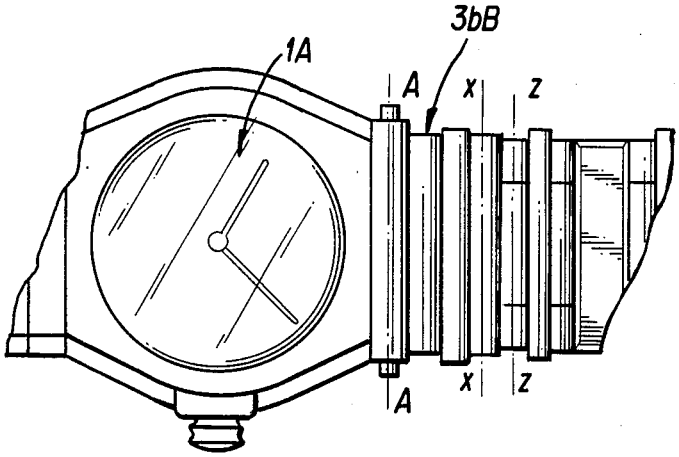
Figure 7:
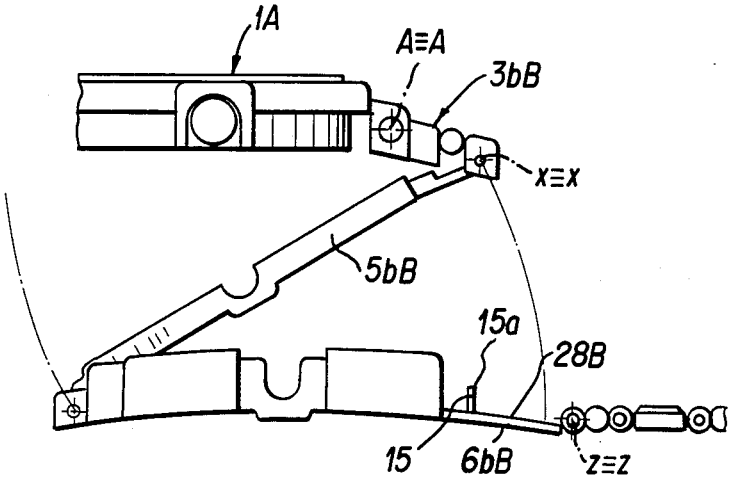

FIGS. 3 and 4, when considered together, show the longitudinal sectional view, in enlarged scale, of the assembly shown in FIG. 1, said sectional view being taken on the center plane B—B;

FIG. 5 shows, in the same enlarged scale as used in FIGS. 3 and 4, the cross section A—A perpendicular to the plane B—B of FIG. 1; and FIGS. 6 and 7 are a partial front view and a partial longitudinal sectional view respectively, similar to those of FIGS. 1 and 2, but concerning the application of the invention to a lady's wrist-watch.

Now referring to the drawings, at first only the main components of the device which is the object of the present invention are considered.

Referring to FIGS. 1 to 5, the body of a man's wrist-watch is generically indicated 1; said watch 1 has been not modified by the present invention in any of the operative parts thereof. Said body 1 is supported and protected laterally and in its lower part by the first element of the device, generally indicated 2 and which is formed, in combination, by a first upper member 3 shaped as a peripheral frame and by a disc-like lower member 4. At one of the sides of the member 3, i.e. the side 3*a* (at the left side of FIG. 1), said member 3 is pivotally connected about the transverse axis w—w to the end portion 7*a* of a strap or bracelet 7, preferably, made of metal, while, at the opposite side 3*b* of the member 3, this latter is hinged, about the parallel axis x—x, to the end 5*b* of the second member or component 5 of the articulated device, while the other end 5*a* of said member 5 (at the left side of FIG. 1) is hinged, about the axis y—y, parallel to the axes x—x and w—w, to the end 6*a* of the third member or component 6 of the articulated device, while at the opposite end 6*b* of its member 6 is hinged, about the axis z—z parallel to the preceding ones, to the other end portion 7*b* of the strap or bracelet 7, so that this latter according to the present invention is formed of a sole continuous link band. The part 2, as has been afore-mentioned, is formed in combination by two members 3 and 4. The member 3 is shaped as a peripheral frame provided with a central opening 25 comprising annular shoulders 25*a*, 25*b* so shaped and positioned so that said member 3 is able to strongly hold the watch 1 between the shoulders 25*a*, 25*b*. The watch 1 is protected, at the lower part thereof by the element 4, designed to be fixed by a pressure effect by means of the peripheral flange 8, to the member 3. The member 4 is designed to protect the bottom wall of the watch-case where the inner delicate mechanisms of the watch are mounted.

At the side, where the articulation axis w—w is provided, the member 3 extends outwards with the part 3*a* which is similar to a bar and is shaped with steps and which extends transversally with regard to the center-plane B—B.

Said part 3a ends with a limb 3a' bent at 90° downwards: on said link 3a hinge members 9a are welded, mounted about a pivot pin 27, while other hinge members 9b designed to co-operate with the first hinge members 9a and the pivot pin 9, are made integral with the end portion 7a of the link strap or bracelet 7. On the inner surface of the limb 3a' notches 10 are arranged having a function which will be hereinafter described. The part 3a has its inner surface 3a'' so shaped as to form together with the outer lower portion 3' of the frame-like member 3 a recess adapted to receive the lateral bar-like parts 5a and 6a of the elements 5 and 6 of the articulated device, which are hinged to each other by means of hinge members 12a, made integral with the body 5 and coaxial hinge members 12b respectively, made integral with the element 6 and all pivotally mounted about the axis y—y of a transverse pivot pin 26. From the hinge members 12a or 12b extend outwards radial small pins or prongs 11 (FIGS. 2 and 4), so positioned and dimensioned as to be able to be inserted by a pressure force, in the notches 10. The part 5a of the member 5 has an upper surface so shaped as to abut against the central part of the inner surface 3a'', while the lower surface of the part 5a facing the part 6a is so shaped to be able to receive said part 6a (FIG. 4).

In correspondence of the conventional push-button 14 of a wrist-watch 1, which serves to control the position of the watch hands, the member 5 and 6 are provided with lateral recesses 35, 36, so positioned and shaped as to permit the members 5, 6 to be inserted around said push-button 14, without interferring with the operation of this latter.

The other end portion 3b of the member 3 (FIG. 3) is also constructed so as to form a transverse bar-like part, the inner surface 3b' of which together with the outer facing side surface 3' of the member 3 defines a recess forming an upper chamber 31, and also adapted to receive the bar0like end portion 5b placed at the right hand of the annular element 5, supporting a tubular hinge member 13, pivotally mounted about the pin 30, carried, at the end portions, thereof by the part 3b. Said chamber 31 is designed to house the components of the safety locking device, provided with manually controllable realising means (FIGS. 3 and 5).

Now referring to FIG. 5, one can see that the chamber 31 extends in the direction of the axis x—x, has a substantially rectangular cross section and is open at its lower part, at least in the central part thereof so as to permit a hook-like-tooth 15 to enter therein, said tooth 15 extending upwards from the bottom of a transverse groove 28, open outwards and arranged in the upper bar-like end portion 6b of the member 6. Along the chamber 31 a sliding member can longitudinally slide, which comprises two transverse walls 19a, 19b and longitudinal upper wall 19. Against the transverse wall 19a abuts the end of a longitudinal rod 21, the enlarged head 21a of which is located in the inside of a bushing 23 in which an expansion spring 24 is mounted which at one of its ends presses against the head 21a of the rod 21 and at the opposite one abuts against the control push-button 22 slidably mounted along the bushing 23. At the opposite end the sliding member 19 rests against the end of a rod 37 by means of the wall 19b, while the enlarged head 37a of said rod 37 slides in the inside of the stationary cap 16 and presses against a spring 17, said cap 16 being connected to the body 3b in any removable manner.

The tooth 15 having a hook head 15a, which is fixed to the bottom of the groove 28, extends upwards therefrom, passing through an orifice 5f arranged in the end portion 5b of the member so that it can enter the longitudinal slot 20 arranged in the wall 19 till it comes in contact with the top wall 3b' of the chamber 31, as the sliding member 19, 19a, 19b is in its rest position.

Facing the side of the tooth 15a, where the hook slot 15c of the tooth 15 opens, a shaped projecting plate 32 is fixed to the lower surface of the longitudinal wall 19. Said plate extends beyond the transverse edge of the longitudinal slot 20, so as to face said slot 15c, of the hook member 15, 15a, so as to be able to enter said slot 15c, as the head 15a of the hook tooth 15, 15a comes in contact with the walls of the upper wall of chamber 31, i.e. with the lower surface 3b'. Therefore the thickness of the longitudinal wall 19 of the sliding member must be substantially equal to the height of the hook-like portion 15a, placed above the slot 15c. The part 15a facing the plate 32 is shaped at 15b so as to promote the engagement, while the thickness of the plate 32 must be not greater than the height of the slot 15c.

As the members 5 and 6 of the articulated device of the invention move so as to come in contact with the element 2 supporting the watch 1 and, in particular, with the part 3 thereof, the hook tooth 15, 15a passes through the orifice 5f so as to reach the chamber 31, in the inside of which it comes in contact by means of the head 15a having shaped edge 15b the facing shaped edge 32a of the plate 32; also the shaped edge 32a is so shaped as to promote its engagement with the shaped edge 15b of head 15a. Said plate 32 is made integral with the walls of the sliding member so that said sliding member is forced to move away, against the effect of the spring 17, until the head 15a is allowed to pass beyond the projecting edge 32a of the plate 32; afterwards the sliding member 19, 19a, 19b can return to its rest position, in which the parts 2, 5, 6 of the articulated device of the invention are held in their safety locking condition and can no more be seen from the outside.

As the wearer wants to take off his wrist-watch, it will be sufficient that he pushes the push-button 22, which, by means of the spring 24 and the rod 21, 21a causes the sliding member 19, 19a, 19b to be moved towards the cap 16 in contrast with the effect of the spring 17. The stroke of the sliding member 19, 19a, 19b is limited by the presence of limiting stop means consisting of slot and pin assemblies 33, 34.

In said stop position of the sliding member (towards the right hand in FIG. 5) the projecting portion or tooth 32a obtained from the plate 32 comes out of the slot 15a of the hook head of the tooth 15, so that the locking tooth 15, 15a can be moved away from the surface 3b' together with the end portion 6b of the element 6, rotating in the clockwise direction, while the element 5 can rotate about the pin 30 in counterclockwise direction.

In FIGS. 6 and 7 a varient of the articulated device is shown to be applied to a lady's wrist-watch 1A. For this intended purpose the articulated device remains substantially identical. It is, however, to be noted that on account of the fact that the ladies' watches are smaller than the men's ones, in order to permit that a safety locking means having a good reliability and having the aforementioned characteristics can be included, it is necessary a compensation for the less length of the elements 2, 5, 6 for a lady's watch than that of those for a man's watch.

Thus it is necessary to give a greater width to the part 3 concerned.

Therefore side bar-like parts 3*a*A and 3*b*B (this latter not shown in FIGS. 6 and 7) will have a greater width, measured along the line B—B so as to have, in particular, in the part 3*b*B a sufficient space to receive a stronger and shorter safety locking means. Therefore the chamber 31 will be shorter and larger, and the groove 28*b*, from which extends the hook tooth 15, 15*a* of the safety snap locking means, will be shorter, but larger than the proceding one.

What is claimed is:

1. An articulated device, for increasing the length of a bracelet or band (7) having first and second ends (7*a*, 7*b*, respectively) incorporating a wrist-watch and provided with an improved safety locking means, in which said device is formed by first, second and third elements (2, 5, 6, respectively) substantially rigid and connected to each other by hinges having first, second, and third parallel transverse rotation axes (x—x; y—y; z—z, respectively) so as to be foldable in a zig-zag relationship one on the other either so that said articulated device can take the minimum length or in which said first, second and third elements can be brought in a substantially mutual coplanar relationship of a maximum length, said second and third elements (5, 6) having first end portions (5*a*, 6*a*) and second end portions (5*b*, 6*b*), respectively, wherein the first element (2) of the device comprises first and second parts (3, 4, respectively) which in combination define an inner space open at its top and adapted to receive the wrist-watch (1, 1*a*), said first and second parts (3, 4) being interconnected to each other by elastic pressure connection means, said first part (3) having first and second sides (3*a*, 3*b*, respectively), said first side (3*a*) being provided with means to be connected to said first end (7*a*) of the bracelet (7) and being so shaped as to receive to elastically lock by locking means (10, 11) the first end portions (5*a*, 6*b*) of the first and second elements (5 and 6, respectively), when in their folded collapsed position, while the second side (3*b*) of the first part (3) is provided with hinge means enabling the first part (3) and second end portion (5*b*) of the second element (5), to pivotally rotate about the first axis (x—x), wherein the first end portion (5*a*) of said second element (5) is hinged to the first end portion (6*a*) of the third element (6) about said second transverse axis (y—y), and wherein the second end portion (6*b*) of the third element (6) is provided with means for connecting it to said second end (7*b*) of the band (7) about the third (z—z) axis, said articulated device having operatively mounted thereon a safety locking means for the articulated device, characterized by the fact that, said safety locking means comprises:

(i) a shaped hook member (15, 15*a*, 15*c*) extending outwardly from the second end portion (6*b*) of the third element (6) and adapted to enter an orifice (5*f*) arranged in the second end portion (5*b*) of the second element (5), when the articulated device is in its collapsed folded position; and (ii) a safety locking sliding member (19, 19*a*, 19*b*, 32) which can be slidingly moved, parallel to the first axis (x—x) into and along a chamber (31) extending parallel to said first axis (x—x) and arranged in the lower part of the second side (3*b*) of the first part (3), said chamber (31) being open at its bottom, and adapted to be closed by an upper shaped part of the second end portion (5*b*) of the second element (5), when the articulated device is in its collapsed position, said safety locking sliding member (19, 19*a*, 19*b*, 32) respectively acting in opposite directions in response to a first spring device (16, 17, 37, 37*a*), adapted to maintain the safety locking sliding member (19, 19*a*, 19*b*, 32) and the hook member (15, 15*a*, 15*c*) in interengaged condition and, respectively, a second spring device (21 to 24) adapted to counteract the action of said first spring device in response to a pressure applied to a manually controllable outer releasing push-button (22), which is a part of said second spring device.

2. An articulated device according to claim 1, wherein, in the upper surface of the second end portion (6*b*) of the third element (6) a shaped groove (28) is arranged, parallel to the hinge axis (x—x, y—y, z—z), said hook member (15) extending outwardly from said shaped groove (28), said hook member being provided with a hook head (15*a*) wherein the hook head (15*a*) at its side facing the first spring device (16, 17, 37, 37*a*) is provided with a slot (15*c*), while hook head (15*a*) is so externally shaped as to promote the engagement of the hook member (15, 15*a*) with a cooperating hook element (32) of the safety locking sliding member (19, 19*a*, 19*b*, 32), said groove (28) being positioned in such a way, that, in the closure condition of the articulated device, a space is defined in the lower part of chamber (31) adapted to receive the second end portions (5*b*, 6*b*) of the second and third elements (5, 6), while said orifice (5*f*) arranged in th second end portion (5*b*) of the second element (5) has a length slightly greater than that of the hook member (15, 15*a*) and is so shaped as to permit said hook member to easily pass therethrough, said hook member (15, 15*a*) having such a height as to allow that in the closure position of the articulated device the upper part of said hook member (15, 15*a*) can come nearly in contact with a lower ceiling surface (3*b*′) of the chamber (31) arranged in the second side (3*b*) of the first part (3).

3. An articulated device according to claim 1, wherein the safety locking sliding member (19, 19*a*, 19*b*, 32) which is slidably mounted in said chamber (31), comprises a main longitudinal wall (19) and first and second transverse end walls (19*a*, 19*b* respectively), perpendicular to the sliding directions of said sliding member, so that said sliding member is able to longitudinally reciprocate in the chamber (31) between two stop positions, and wherein the second transverse end wall (19*b*) is put under the action of the first spring device (16, 17, 37, 37*a*), said first spring device including a helical compression spring (17) interposed between a longitudinal rod (37) having an enlarged head (37*a*) and a stationary, removable cap (16), said enlarged head (37*a*) being slidably mounted in said cap (16), wherein the longitudinal wall (19) of the sliding member is provided with a longitudinal slot (20) for the passage of the hook member (15, 15*a*), said hook member being provided with a slot (15*c*), said longitudinal slot (20) of the longitudinal wall (19) having a length greater than that of said hook member (15, 15*a*), wherein a short plate (32) is fixed to the lower surface of the longitudinal wall (19) and projects beyond the transverse edge of said longitudinal slot (20) just facing said slot (15*c*) of the hook member, said short plate (32) having a thickness less than the height of the slot (15*c*) of the hook member and extending beyond said transverse edge of the slot (20) by such an extent so as to form a projecting hook means (32*a*) shaped so as to promote the engagement into the slot (15*c*) of the hook member and which acts as a countertooth, cooperating with the hook member (15, 15*a*) in order to create a safety locking means, which can be released only in response to a displacement of the sliding member (19, 19*a*, 19*b*) against the effect of the spring (17) caused by the compression of a second spring (24) of the second spring device (21 to 24), due to a pressure applied by the user on the releasing push button (22).

* * * * *